US010745912B2

(12) United States Patent
Zhang et al.

(10) Patent No.: US 10,745,912 B2
(45) Date of Patent: Aug. 18, 2020

(54) ASSEMBLED DOUBLE STEEL-CONCRETE COMPOSITE SHEAR WALL EMBEDDED WITH DAMPING INTERLAYER AND METHOD FOR MOUNTING SAME

(71) Applicant: Chunwei Zhang, Qingdao, Shandong (CN)

(72) Inventors: Chunwei Zhang, Shandong (CN); Limeng Zhu, Shandong (CN); Li Sun, Liaoning (CN); Dong An, Shandong (CN); Jie Zheng, Shandong (CN); Longfei Mi, Shandong (CN)

(73) Assignee: Chunwei Zhang, Qingdao (CN)

( * ) Notice: Subject to any disclaimer, the term of this patent is extended or adjusted under 35 U.S.C. 154(b) by 0 days.

(21) Appl. No.: 16/675,550

(22) Filed: Nov. 6, 2019

(65) Prior Publication Data

US 2020/0095762 A1 Mar. 26, 2020

Related U.S. Application Data

(63) Continuation of application No. PCT/CN2019/094543, filed on Jul. 3, 2019.

(30) Foreign Application Priority Data

Jul. 24, 2018 (CN) ..... 2018 1 0819435

(51) Int. Cl.
*E04B 1/98* (2006.01)
*E04B 2/58* (2006.01)

(52) U.S. Cl.
CPC ..... *E04B 1/985* (2013.01); *E04B 2/58* (2013.01)

(58) Field of Classification Search
CPC . E04B 1/985; E04B 2/58; E04B 1/942; E04B 1/7604; E04B 1/92; E04B 2/02;
(Continued)

(56) References Cited

U.S. PATENT DOCUMENTS 2,280,647 A * 4/1942 Hawes ..... E04C 2/3405 52/200
3,585,894 A * 6/1971 Brown ..... F16B 5/02 411/387.4

(Continued)

FOREIGN PATENT DOCUMENTS

CN 102444224 A 5/2012
CN 106013518 A 10/2016

(Continued)

OTHER PUBLICATIONS

Machine translation of foreign reference CN106812229, obtained from https://worldwide.espacenet.com/patent/search/family/059116299/publication/CN106812229A?q=CN106812229 (last accessed on Jan. 28, 2020) (Year: 2020).*

*Primary Examiner* — Theodore V Adamos
(74) *Attorney, Agent, or Firm* — Wayne & Ken, LLC; Tony Hom

(57) ABSTRACT

This invention relates to architecture techniques, and more particularly to an assembled double steel-concrete composite shear wall embedded with a damping interlayer, which includes a double steel layer, a double damping interlayer and a concrete layer. The shear wall is formed by bolted bar joints. The double steel layer includes two first steel plates which are arranged along a length of the assembled double steel-concrete composite shear wall in a parallel manner and two second steel plates along a width of the assembled double steel-concrete composite shear wall. The double damping interlayer includes a first damping interlayer which locates between the first steel plates and the concrete layer and a second damping interlayer which surrounds the bolted bar joints and is surrounded by a steel tube.

9 Claims, 5 Drawing Sheets

(58) Field of Classification Search
CPC . E04B 2/44; E04B 2/54; E04B 2/8611; E04B 2/8647; E04B 1/7616; E04B 1/98; E04C 5/165; E04C 5/18; E04C 5/208
See application file for complete search history.

(56) References Cited

U.S. PATENT DOCUMENTS 4,015,386 A * 4/1977 Cook ..... E04B 1/942 52/232
4,090,665 A * 5/1978 Schlesener ..... E01B 3/32 238/349
4,669,234 A * 6/1987 Wilnau ..... E04B 2/8647 52/381
5,059,059 A * 10/1991 Cox ..... B23P 6/00 403/408.1
5,638,652 A * 6/1997 Shinoda ..... E04B 1/161 52/414
5,657,601 A * 8/1997 Bean ..... E04B 2/8635 249/214
5,927,032 A * 7/1999 Record ..... E04C 2/292 52/284
6,418,686 B1 * 7/2002 Record ..... E04C 2/288 52/284
6,532,710 B2 * 3/2003 Terry ..... E04B 2/8605 52/283
2003/0071189 A1 * 4/2003 Petkau ..... E04G 17/0657 249/190
2010/0108438 A1 * 5/2010 Duffy ..... B32B 3/266 181/290
2018/0030755 A1 * 2/2018 Patterson ..... E04H 9/04
2018/0127966 A1 * 5/2018 Kurosawa ..... E04B 1/185

FOREIGN PATENT DOCUMENTS

CN 106812229 A 6/2017
CN 106836492 A 6/2017
CN 107882178 A 4/2018
CN 108049530 A 5/2018
CN 108894360 A 11/2018
JP 2000170285 A 6/2000

* cited by examiner

ASSEMBLED DOUBLE STEEL-CONCRETE COMPOSITE SHEAR WALL EMBEDDED WITH DAMPING INTERLAYER AND METHOD FOR MOUNTING SAME

CROSS-REFERENCE TO RELATED APPLICATIONS

This application is a continuation of International Application No. PCT/CN2019/094543 with a filling date of Jul. 3, 2019, designating the United States, now pending, and further claims to the benefit of priority from Chinese Application No. 201810819435.7 with a filing date of Jul. 24, 2018. The content of the aforementioned applications, including any intervening amendments thereto, are incorporated herein by reference.

TECHNICAL FIELD

This application relates to the field of construction, and more particularly to an assembled double steel-concrete composite shear wall embedded with a damping interlayer.

BACKGROUND OF THE INVENTION

Double steel-concrete composite shear wall is a new shear wall developed on the basis of single steel-concrete composite shear walls, which is capable of effectively delaying the buckling of steel plates to achieve an elastoplastic state and greatly improve the ultimate shear capacity and the lateral force resistance of the steel-concrete composite shear wall. The double steel-concrete composite shear wall has the advantages of light weight, good ductility and a fast construction speed, and concrete in corners is hard to crack. However, existing double steel-concrete composite shear walls are mainly cast in site and are weak in energy dissipation, which means the double steel-concrete composite shear wall will deform easily to consume energy when an earthquake comes. It is time-consuming and costly to either repair the wall or replace the steel plate.

The double steel-concrete composite shear wall itself is weak in resisting explosion and impact, but the out-of-plane explosion and impact resistance of the double steel-concrete composite shear wall can be improved by adding damping materials with high performance. As a viscoelastic material, rubber materials having strong elasticity, large deformation and a good barrier property are widely used in structural engineering. Currently, rubbers are mainly applied for rubber bearings and viscoelastic damping walls. The viscoelastic damping wall is an energy-consuming member with steel plates outside and a damping material inside, but it cannot function as a bearing.

After an earthquake, the double steel-concrete composite shear wall tends to deform to consume energy. Thus, such shear wall needs to be repaired when it is not seriously deformed, and when there is a serious deformation, the steel plates of the shear wall should be replaced because they cannot be repaired. Moreover, most double steel-concrete composite shear walls are cast in place, which makes it time-consuming and costly to either repair the wall or replace the steel plates.

In addition, defects of initial bending and eccentricities cannot be greatly avoided when the double steel-concrete composite shear wall adopts thin or ultrathin steel plates.

SUMMARY OF THE INVENTION

An object of this invention is to overcome the above-mentioned shortcomings of a double steel-concrete composite shear wall in the prior art and to provide an assembled double steel-concrete composite shear wall embedded with a damping interlayer, which realizes a controllable slipping between the steel plates and the concrete section, provides high damping of the structure, good seismic performance by improving energy dissipation ability of the structure and enhanced out-of-plane explosion and impact resistance, makes it convenient to be constructed and disassembled, and avoids initial defects of the steel plates and grout leakage after concrete pouring.

To achieve the above object, the invention adopts the following technical solutions.

The invention provides an assembled double steel-concrete composite shear wall embedded with a damping interlayer, including a double steel layer, a double damping interlayer and a concrete layer. The shear wall is formed by bolted bar joints. The double steel layer includes two first steel plates which are arranged along a length of the assembled double steel-concrete composite shear wall in a parallel manner and two second steel plates along a width of the assembled double steel-concrete composite shear wall. The double damping interlayer includes a first damping interlayer which is located between the first steel plates and the concrete layer and a second damping interlayer which surrounds the bolted bar joints and is surrounded by a steel tube. Each of the bolted bar joints includes a binding bar component with support plates and a high-strength binding bar component. The second damping interlayer is embedded between the binding bar component with support plates and the steel tube to realize a slipping of the first damping interlayer between the first steel plates and the section of the concrete layer. The steel tube is embedded between the second damping interlayer and the concrete layer, which makes the concrete layer under stress suffer a multidirectional pressure, compensating the reduction of the wall compression and shear capacity caused by the additional second damping layer, and meanwhile protects the second damping layer from damage when the concrete is poured to provide a better working environment.

In the shear wall, the first steel plates, the first damping interlayer and the concrete layer are provided sequentially from the outside to the inside.

A plurality of bolt holes are correspondingly provided on the first steel plates; the binding bar component with support plates and the high-strength binding bar component penetrate the first steel plates and are anchored by bolts.

The binding bar component with support plates includes a binding bar, two support plates and a plurality of nuts. A hole is provided on the first damping interlayer, and a size and a shape of the hole match those of the support plates. The binding bar component with support plates communicates the first steel plates at both sides. In addition, when the damping interlayer slips between the steel plates and the section of the concrete to deform for energy consumption, the steel plates and the concrete are contacted to promote the interaction therebetween, compensating the reduction of the wall bearing capacity caused by the additional damping layer.

A cross section of the two second steel plates is C-shaped, and the two second steel plates open inwardly, protecting the inner high-strength binding bar.

A plurality of bolt holes are provided on the second steel plates; the high-strength binding bar component penetrates the second steel plates and is anchored by nuts.

The first damping interlayer is made of rubber materials or aluminum foam materials. Taking advantage of the hysteretic energy consumption of the rubber materials, the mechanical energy generated by the structural vibration is converted into internal energy, thereby reducing the structure dynamic response and meanwhile enhancing the out-of-plane explosion and impact resistance of the shear wall.

The second damping interlayer is made of high-damping rubber materials.

The high-strength binding bar component includes a friction-typed high-strength binding bar and a plurality of nuts. The high-strength binding bar is employed to resist the local pressure generated by the excessive force at the end connection. The high-strength binding bar is configured to connect the first steel plates and the second steel plates and to connect the wall with the matched horizontal connector, which makes it convenient to be constructed and disassembled.

The binding bar component with support plates is evenly arranged in a direction perpendicular to the first steel plates with a spacing range of 100-150 mm.

The high-strength binding bar component is evenly arranged in a direction perpendicular to the first steel plates with a spacing range of 100-150 mm.

The hole on the first damping interlayer is square.

A thickness of the first damping interlayer is twice that of each of the support plates.

In the invention, the first damping interlayer is embedded between the first steel plates, the second steel plates and the concrete layer, which realizes a controllable slipping between the first steel plates and the section of the concrete layer, enhances the damping of the wall and increases the energy dissipation. Besides, aluminum foam damping materials with high porosity are employed to enhance the out-of-plane explosion and impact resistance of the shear wall. Moreover, a square hole is provided on the first damping interlayer. The support plates with a thickness half that of the hole are embedded in the hole, while the other half of the hole is filled with poured concrete, compensating the reduction of the wall bearing capacity caused by the additional damping layer, preventing the grout leakage and improving the concrete curing environment. The hole of the first damping interlayer can also be other shapes, such as a triangle, a circle, etc.

The invention provides a method for mounting the assembled double steel-concrete composite shear wall embedded with a damping interlayer, which is specifically described as follows.

a) An adhesive is respectively applied onto the two first steel plates, the two second steel plates and the first damping interlayer; the two first steel plates are firmly bonded with the first damping interlayer, and the two second steel plates are firmly bonded with the first damping interlayer.

b) The second damping interlayer is respectively bonded to the binding bar component with support plates and the high-strength binding bar component and then is respectively covered with the steel tube.

c) The high-strength binding bar component at both sides of a wall is mounted and fixed to stabilize respective components of the wall.

d) An adhesive is respectively applied onto the support plates; the support plates are placed in the hole of the first damping layer to firmly bond the first steel plates; the binding bar passes through the wall and then the nuts are tightened, so that the binding bar component with support plates is fixedly mounted e) Concrete is poured from an upper side of the wall to form the concrete layer.

The present invention has the following beneficial effects.

(1) The assembled double steel-concrete composite shear wall embedded with a damping interlayer employs an additional damping interlayer in a double steel-concrete composite shear wall, which not only uses the shear deformation between the damping materials and the steel plates and between the damping materials and a section of the concrete to consume energy, realizing a controllable slipping between the first steel plates and the section of the concrete layer, but also effectively improves the damping of the structure to reduce the seismic response of the structure, thus achieving good seismic performance by improving energy dissipation ability of the structure.

(2) The shear wall of the invention employs damping materials, such as high porosity aluminum foam, which is beneficial to enhance the out-of-plane explosion and impact resistance of the shear wall.

(3) The shear wall of the invention designs a hole for adding support plates in the damping interlayer made of rubber materials, so that when the damping interlayer slips between the steel plates and the section of the concrete to deform for energy consumption, the steel plates and the concrete are contacted to promote the interaction therebetween, compensating the reduction of the wall bearing capacity caused by the additional damping layer.

(4) The binding bar with support plates in the shear wall is capable of avoiding initial defects of concave when the steel plates of the double steel-concrete composite shear wall are thin or ultrathin.

(5) The shear wall provides the damping interlayer and the support plates, which prevents the grout leakage and improves the concrete curing environment.

(6) The binding bar and the steel plates are connected via bolts, avoiding problems such as residual deformation and residual stress caused by traditional shear wall welding.

(7) The binding bars at both sides are capable of connecting the wall and the bolts of the matched connector to form an unit of an assembled double steel-concrete composite shear wall embedded with a damping interlayer, which is convenient to be constructed and disassembled after damage.

Figure 1:
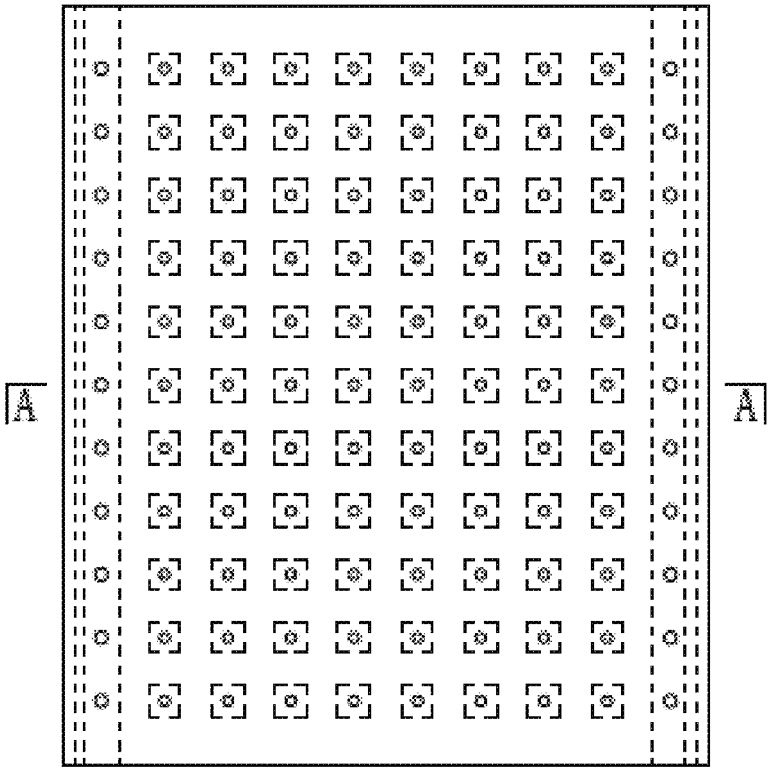
FIG. 1 is a front view of an assembled double steel-concrete composite shear wall embedded with a damping interlayer according to an embodiment of the invention.

In the drawings: 1, first steel plate; 2, second steel plate; 3, first damping interlayer; 4, second interlayer; 5, concrete layer; 6, binding bar component with support plates; 6-1, binding bar; 6-2, support plate; 6-3, nut; 7, high-strength binding bar component; 7-1, high-strength binding bar; 7-2, high-strength nut; 8, steel tube; 9, hole.

DETAILED DESCRIPTION OF EMBODIMENTS

The invention will be further described in detail below with reference to the accompanying drawings.

EXAMPLE 1

Figure 2:
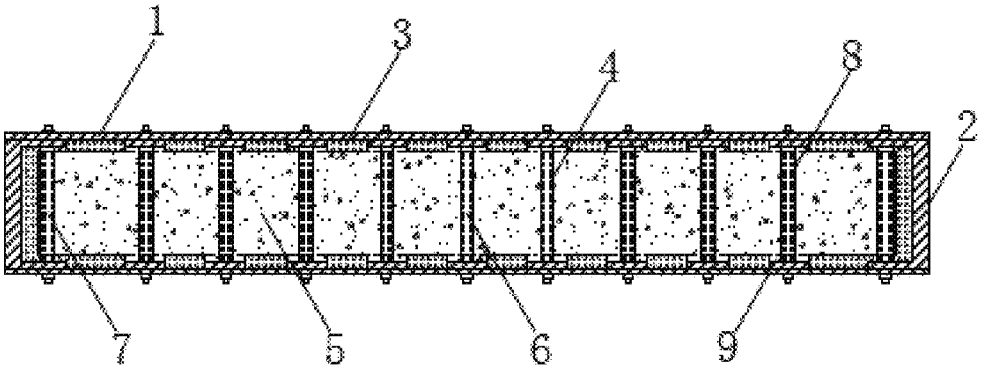
FIG. 2 is a section view of FIG. 1 taken along line A-A.
Figure 3:
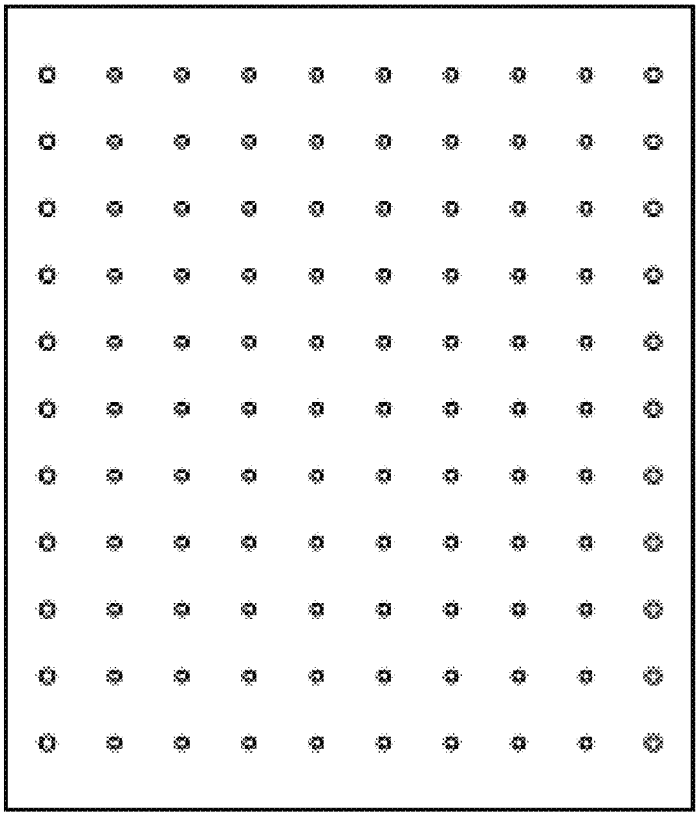
FIG. 3 is a front view of a first steel plate according to an embodiment of the invention.
Figure 4:
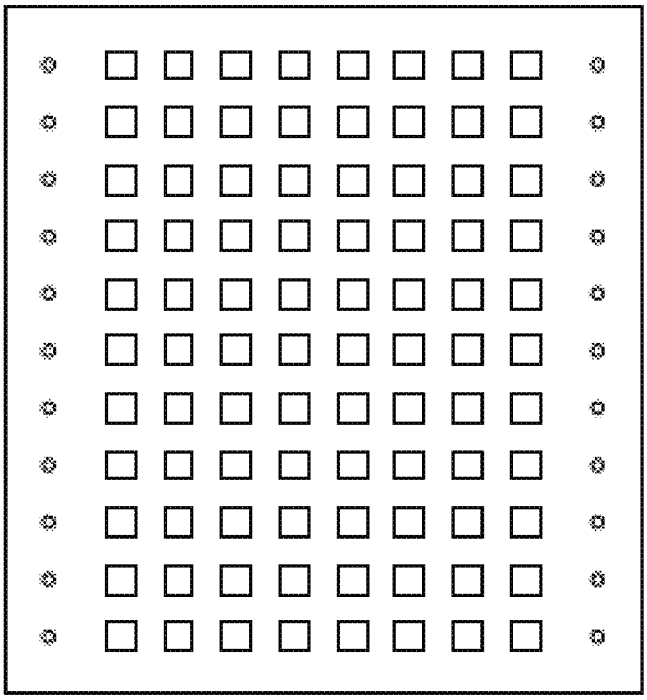
FIG. 4 is a front view of a first damping interlayer according to an embodiment of the invention.
Figure 5:
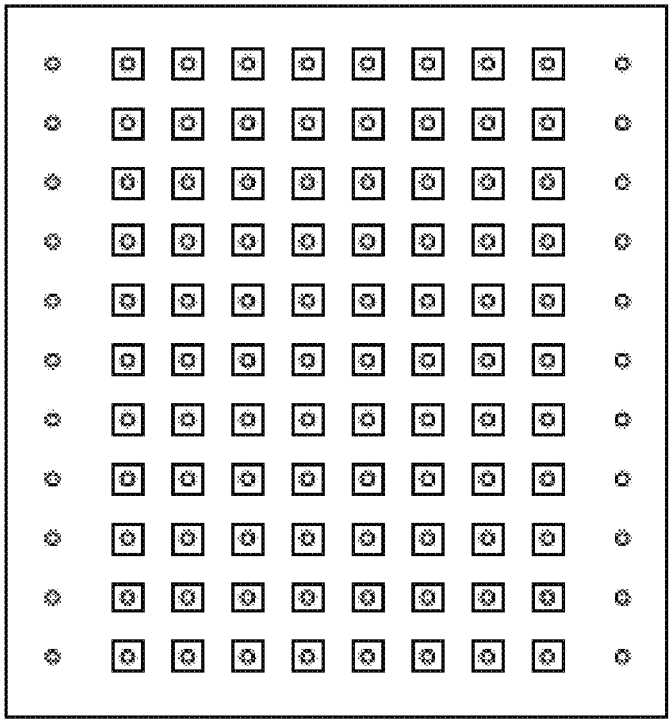
FIG. 5 is a front view of a concrete layer according to an embodiment of the invention.
Figure 6:
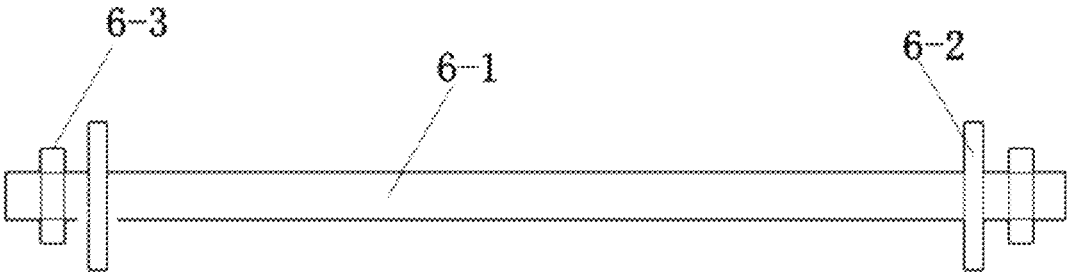
FIG. 6 is a front view of a binding bar component with support plates according to an embodiment of the invention.
Figure 7:
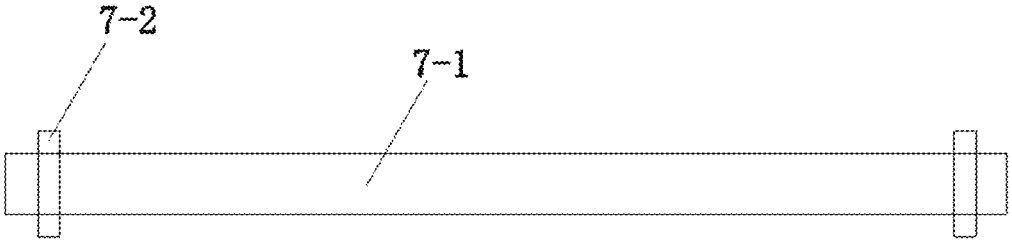
FIG. 7 is a front view of a high-strength binding bar component according to an embodiment of the invention.
Figure 8:
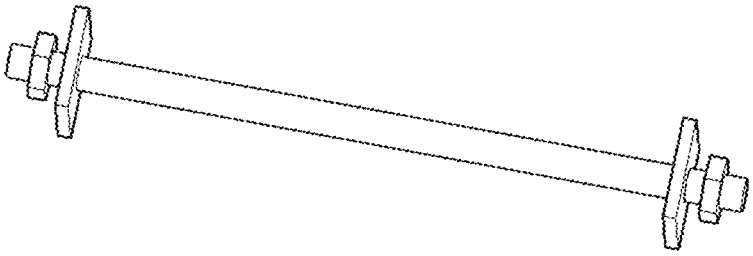
FIG. 8 is a perspective view of a binding bar component with support plates according to an embodiment of the invention.

As shown in FIGS. 1-8, the invention provides an assembled double steel-concrete composite shear wall embedded with a damping interlayer, including a double steel layer, a double damping interlayer and a concrete layer. The shear wall is formed by bolted bar joints. First steel plates, a first damping interlayer and the concrete layer are provided sequentially from an outer side to an inner side, forming a symmetrical wall structure. The double steel layer includes two first steel plates 1 which are arranged along a length of the assembled double steel-concrete composite shear wall in a parallel manner and two second steel plates 2 located at a section of the first steel plates along a width of the assembled double steel-concrete composite shear wall. The double damping interlayer includes a first damping interlayer 3 which locates between the first steel plates and a concrete layer 5 and a second damping interlayer 4 which surrounds the bolted bar joints and is surrounded by a steel tube 8. Each of the bolted bar joints includes a binding bar component with support plates 6 and a high-strength binding bar component 7, which connect the first steel plates and the second steel plates.

A binding bar of the binding bar component with support plates and a high-strength binding bar of the high-strength binding bar component penetrate the first steel plates through a plurality of bolt holes provided on the first steel plates. The binding bar and the high-strength binding bar are anchored by nuts. The high-strength binding bar component penetrates the second steel plates through a plurality of bolt holes provided on the second steel plates and is anchored by nuts. A cross section of the two second steel plates is C-shaped, and a web side of the two second steel plates faces outside, protecting the inner high-strength binding bar. In all, there are two first steel plates and two second steel plates.

The first damping interlayer is embedded between the first steel plates, the second steel plates and the concrete layer, which realizes a controllable slipping between the first steel plates and a section of the concrete layer, enhances the damping of the wall and increases the energy dissipation. Besides, aluminum foam damping materials with high porosity are employed to enhance the out-of-plane explosion and impact resistance of the shear wall. Moreover, a square hole 9 is provided on the first damping interlayer. The support plates with a thickness half that of the hole is embedded in the hole and the other half of the hole is filled with poured concrete, compensating the reduction of the wall bearing capacity caused by the additional damping layer, preventing the grout leakage and improving the concrete curing environment. To realize the shear slipping deformation of the first damping interlayer between the first steel plates and the section of the concrete layer, the second damping interlayer made of high damping rubber materials is provided and embedded between the concrete layer and the binding bar component with support plates.

In the binding bar component with support plates and the high-strength binding bar component, the binding bar and the steel plates are connected via bolts, avoiding problems such as residual deformation and residual stress caused by welding. The binding bar component with support plates includes the binding bar 6-1, two support plates 6-2 and a plurality of nuts 6-3. The size and shape of the support plates match that of the hole of the first damping interlayer. The binding bar component with support plates is evenly arranged in vertical and horizontal directions, with a spacing of 100 mm. Therefore, the first steel plates at both sides are communicated. When the first damping interlayer slips between the steel plates and the section of the concrete layer to deform for energy consumption, the steel plates and the concrete are contacted to promote the interaction therebetween, compensating the reduction of the wall bearing capacity caused by the additional damping layer. The high-strength binding bar component includes a friction-typed high-strength binding bar 7-1 and a plurality of high-strength nuts 7-2, which are evenly arranged in a vertical direction with a spacing of 100 mm. An unit of an assembled double steel-concrete composite shear wall embedded with a damping interlayer is formed by employing the high-strength binding bar to resist the local pressure effect generated by the excessive force at the end connection, to connect the first steel plates and the second steel plates, further to connect the wall and the bolts of the matched connector, which makes it convenient to be constructed and disassembled after damage.

The steel tube is seamless steel tube with a thick of 1 mm, and surrounds the second damping interlayer and is embedded between the second damping interlayer and the concrete layer, which makes the concrete layer under stress suffer a three-way confining pressure, compensating the reduction of the wall bearing capacity caused by the additional second damping layer. Meanwhile, the second damping layer is prevented from being damaged when the concrete is poured to provide a better working environment.

EXAMPLE 2

This embodiment is similar to Example 1 except for the following technical features. The first damping layer is embedded between the first steel plates, the second steel plates and the concrete layer, and is made of aluminum foam materials, the high porosity and energy absorption thereof enhance the out-of-plane explosion and impact resistance of the wall. The second damping interlayer is still made of high damping rubber materials and is embedded between the concrete layer and the binding bar component with support plates to realize the shear slipping of the damping layer together with the first damping layer.

Example 2 is mainly employed when the wall requires high explosion and impact resistance. Similarly, other material types can also be employed, and the hole of the first damping interlayer can also be other shapes, such as a triangle, a circle, etc., to show the unique material properties, such as sound insulation, radiation attenuation, vibration reduction, etc.

EXAMPLE 3

The invention provided a method for mounting the assembled double steel-concrete composite shear wall embedded with a damping interlayer, which is specifically described as follows.

a) An adhesive is respectively applied onto the two first steel plates, the two second steel plates and the first damping interlayer; the two first steel plates are firmly bonded with the first damping interlayer, and the two second steel plates are firmly bonded with the first damping interlayer.

b) The second damping interlayer is respectively bonded to the binding bar component with support plates and the high-strength binding bar component, and then is respectively covered with the steel tube.

c) The high-strength binding bar component at both sides of the wall is mounted and fixed to stabilize each component of the wall.

d) An adhesive is respectively applied onto the support plates; the support plates are placed in the hole of the first damping layer to firmly bond the first steel plates; the binding bar passes through the wall and then the nuts are tightened, so that the binding bar component with support plates is fixedly mounted.

e) Concrete is poured from an upper side of the wall to form the concrete layer.

Obviously, the above-mentioned embodiments are merely illustrative, and are not intended to limit the scope of the invention. Various variations and modifications made by those skilled in the art without any creative effort shall fall within the scope of the invention.

What is claimed is:

1. An assembled double steel-concrete composite shear wall embedded with a damping interlayer, comprising: a double steel layer, a double damping interlayer and a concrete layer;

wherein the assembled double steel-concrete composite shear wall is formed by bolted bar joints;

the double steel layer comprises two first steel plates which are arranged along a length of the assembled double steel-concrete composite shear wall in a parallel manner and two second steel plates along a width of the assembled double steel-concrete composite shear wall;

the double damping interlayer comprises a first damping interlayer located between and in contact with the first steel plates and the concrete layer and second damping interlayers surrounding the bolted bar joints and surrounded by steel tubes, wherein the second damping interlayers are made of rubber materials; and the bolted bar joints comprise first binding bar components with support plates and second binding bar components without support plates, wherein the support plates of the first binding bar components are placed in the first damping interlayer.

2. The assembled double steel-concrete composite shear wall of claim 1, wherein a plurality of bolt holes are correspondingly provided on the first steel plates; the first binding bar components with support plates and the second binding bar components penetrate the first steel plates and are anchored by bolts.

3. The assembled double steel-concrete composite shear wall of claim 1, wherein each of the first binding bar components with support plates comprises a binding bar, two support plates and a plurality of nuts; and holes are provided on the first damping interlayer, and a shape of the holes matches that of the support plates.

4. The assembled double steel-concrete composite shear wall of claim 3, wherein the holes on the first damping interlayer are square.

5. The assembled double steel-concrete composite shear wall of claim 3, wherein the support plates with a thickness half that of the holes are embedded in the holes and connected with the first steel plates and an other half of the holes is filled with poured concrete.

6. The assembled double steel-concrete composite shear wall of claim 1, wherein a cross section of the two second steel plates is C-shaped, and a web side of the two second steel plates faces outside.

7. The assembled double steel-concrete composite shear wall of claim 1, wherein a plurality of bolt holes are provided on the second steel plates; the second binding bar components penetrate the two second steel plates, and are anchored by nuts.

8. The assembled double steel-concrete composite shear wall of claim 1, wherein the first damping interlayer is made of rubber materials or aluminum foam materials.

9. A method for mounting the assembled double steel-concrete composite shear wall of claim 3, comprising:

a) respectively applying an adhesive onto two first steel plates, two second steel plates and a first damping interlayer, firmly bonding the two first steel plates and the first damping interlayer, and firmly bonding the two second steel plates and the first damping interlayer;

b) bonding second damping interlayers respectively to first binding bar components with support plates and second binding bar components and then respectively covering the second damping interlayers with steel tubes;

c) mounting and fixing the second binding bar components at both sides of the shear wall to stabilize respective components of the shear wall;

d) respectively applying an adhesive on the support plates; placing the support plates in holes of the first damping interlayer to firmly bond the two first steel plates; passing the first binding bar component with support plates through the shear wall, and then tightening nuts, so that the first binding bar components with support plates is fixedly mounted; and e) pouring concrete from an upper side of the shear wall to form a concrete layer, so that the first damping interlayer is located between and in contact with the first steel plates and the concrete layer.

* * * * *